United States Patent [19]

Nausedas

[11] Patent Number: 4,541,226

[45] Date of Patent: Sep. 17, 1985

[54] PACKAGING METHOD AND APPARATUS

[75] Inventor: Joseph A. Nausedas, Oak Forest, Ill.

[73] Assignee: Union Carbide Corporation, Danbury, Conn.

[21] Appl. No.: 454,481

[22] Filed: Dec. 29, 1982

[51] Int. Cl.[4] ..... B65H 3/58; B65B 43/36

[52] U.S. Cl. ..... 53/459; 53/385; 53/571; 211/57.1; 221/312 A; 248/100

[58] Field of Search ..... 53/459, 473, 492, 384, 53/385, 390, 571, 572; 248/100; 206/554; 221/312 A; 211/57.1

[56] References Cited

U.S. PATENT DOCUMENTS

| | | | |
|---|---|---|---|
| 3,312,339 | 4/1967 | Million | 53/572 |
| 3,763,627 | 10/1973 | Kupcikevicius | 53/189 |
| 3,770,134 | 11/1973 | Kupcikevicius | 211/57 |
| 3,777,930 | 12/1973 | Ericson | 221/26 |
| 3,783,580 | 1/1974 | Raudys | 53/29 |
| 3,868,807 | 3/1975 | Noyes et al. | 53/459 |
| 3,918,589 | 11/1975 | Nausedas | 211/57 |
| 4,158,943 | 6/1979 | Lack et al. | 53/385 |
| 4,262,803 | 4/1981 | Nausedas | 206/554 |
| 4,277,930 | 7/1981 | Nausedas | 53/396 |

FOREIGN PATENT DOCUMENTS

| | | | |
|---|---|---|---|
| 2700222 | 7/1978 | Fed. Rep. of Germany | 53/572 |

*Primary Examiner*—W. D. Bray

*Attorney, Agent, or Firm*—John R. Doherty

[57] ABSTRACT

Flexible packaging bags are sequentially air-opened one at a time at a packaging station and filled with an article to be packaged while resting on top of a packaging table, which is removable so as to expose an area beneath the table in which a stacked and wicket held supply of the packaging bags is stored for use in the packaging operation, a selected number of the bags being periodically removed from the stacked supply of bags and transferred to the packaging station while still held by the wicket.

27 Claims, 8 Drawing Figures

PACKAGING METHOD AND APPARATUS

TECHNICAL FIELD

The present invention relates to the packaging of articles such as food products and the like in flexible packaging bags made from thin plastic sheet material. More specifically, the present invention relates to an improved packaging method and apparatus for sequentially opening flattened, flexible packaging bags one at a time from a stacked and wicket held supply of such bags and then filling each opened bag with an article to be packaged. In a more specific aspect, the present invention is directed to an improved packaging method and apparatus for sequentially opening and filling flexible packaging bags in the manner as described which allows the use of a stacked and wicket held supply of bags incorporating a significantly greater number of individual bags than heretofore possible, thereby facilitating the packaging operation and improving the efficiency thereof.

BACKGROUND ART

Packaging operations in industry are of significant import and interest towards promoting the rapid, efficient and economical packaging of products for the market. Food packaging generally and particularly the bakery and meat packaging industry require additionally strict maintenance of sanitary conditions. Automatic or semiautomatic packaging techniques have been developed towards achievement of these desired goals. Semiautomatic packaging techniques, that is to say, those requiring the cooperation of a human operator with a machine, are uniquely of interest to the bakery and meat packing industry since the products being packaged frequently are not exactly alike as to size, shape and weight, a circumstance militating against fully automatic packing. To the extent that food products, such as bakery goods, meat cuts and the like are at least sufficiently alike in size, shape and weight in a given series to permit the use of packaging bags of the same size and material, some degree of automation in the packaging operation is possible.

U.S. Pat. No. 3,763,627 to Kupcikevicius et al. is illustrative of such semi-automatic packaging techniques and apparatus. As disclosed therein, the packaging operation is carried out by placing a number of flexible packaging bags adjacent to the packaging apparatus which is equipped with an air blower. The blower directs a stream of air into the open end of each bag in order to inflate the bags and facilitate entry of articles such as bakery goods, meat cuts or other food products. The flexible packaging bags are arranged in flatwise contiguous manner one on top of the other to form a stacked supply of bags which is held together by a wicket. Each bag is provided with two wicket holes which are maintained in substantial registration with the wicket holes in respectively contiguous bags in the stack. The wicket extends through the wicket holes in each bag and is usually secured at one end of the stack in order to hold the same neatly in a bundle. Various types of wickets can be used such as those disclosed, for example, in U.S. Pat. Nos. 3,770,134 and 3,777,930.

During the packaging operation, a stacked and wicket held supply of packaging bags is placed on a flat surface or table adjacent to the packaging station. The discharge end of the blower is then located adjacent to the stacked supply of bags with the nozzle resting on top of the wicket. The wicket is formed at its center with a retaining element which carries the weight of the nozzle and which in turn bears down on top of the stacked supply of bags to hold the same in place. The packaging apparatus is usually provided with locking devices such as sockets or the like, which receive and hold the ends of the wicket. This arrangement assures proper alignment of the bags with respect to the discharge end of the nozzle. The blower directs a stream of air toward the bag stack which opens and inflates the topmost bag. The article to be packaged such as precut meat is then placed inside the inflated bag by the operator. The article filled bag is easily removed from the wicket by simply pulling the bag in an opposite direction. This immediately exposes the next contiguous bag in the stacked supply of bags and the whole operation is repeated again in sequence.

It will be readily apparent from the above description that the size and particularly the height of the stacked and wicket held supply of bags must necessarily be limited to some practical dimension which will not interfere with or obstruct operation of the packaging apparatus. For example, where it is desirable to incorporate a large number of packaging bags in a single stack of bags for purposes of efficiency or convenience, it may not be possible owing to the increased size or height of the bag stack to properly locate the blower nozzle on top of the the wicket. Another serious problem has been that whenever the number or "count" of individual bags employed in the stack is significantly increased, the weight of the stack increases and the stack may become bulky and difficult to handle. The added height of the stack of bags frequently leads to difficult problems since the locking devices used to hold the wickets in place may not be able to sustain the added force applied to them. Accordingly, the wickets may loosen and allow the bags to move in a direction away from the blower nozzle. As a consequence, it may be necessary at times to stop the packaging operation at least temporarily to realign the bags.

It is therefore an important object of the present invention to provide an improved method and apparatus for packaging articles, particularly food products and the like, in flexible packaging bags, which is far more reliable, practical and economical.

Another more specific object of the present invention is to provide such an improved packaging method and apparatus which will allow a greater number of individual bags to be incorporated into each stacked and wicket held supply of bags than heretofore possible without at the same time causing any serious misalignment problems.

Still another object of the present invention is to provide such an improved packaging method and apparatus which will permit a number of the packaging bags to be taken from the stacked supply of bags at one time and placed in position ready for use at the packaging station while the remaining bags in the stack are held apart in a separate storage area.

DISCLOSURE OF THE INVENTION

The present invention is directed to an improved method and apparatus for packaging articles, particularly food products such as bakery goods, meat cuts and the like, in flexible packaging bags, which method and apparatus are far more reliable, practical and economical than those of the prior art. In a broad aspect, the present invention comprehends a packaging method for sequentially opening flattened flexible packaging bags one at a time at a packaging station and then filling each open bag with an article to be packaged, each bag having wicket holes provided in a portion thereof adjacent to its open end, comprising:

(a) providing a plurality of the packaging bags arranged in a flatwise contiguous manner one on top of the other forming a stacked supply of packaging bags, each bag having wicket holes maintained in substantial registration with the wicket holes in adjacent bags, the stacked supply of packaging bags being held together by a wicket including an upper portion and lower portion, the lower portion of the wicket being contiguous with the upper portion and extending through the wicket holes provided in each bag, the upper portion of the wicket extending outwardly beyond the stacked supply of packaging bags;

(b) placing the stacked and wicket held supply of packaging bags within a storage area located beneath the packaging station;

(c) selecting one or more of the packaging bags from the top of the stacked supply of bags and removing the same from the storage area while still held on the wicket;

(d) guiding the selected packaging bags along the upper portion of the wicket;

(e) holding the upper portion of the wicket at a location above the stacked supply of packaging bags (f) placing a substantially flat, horizontal surface underneath the selected packaging bags, the substantially flat, horizontal surface overlying the remainder of the stacked supply of bags held within said storage area;

(g) retaining the upper portion of the wicket in place at the packaging station;

(h) placing the selected number of packaging bags down on top of the substantially flat, horizontal surface with the open end of the bags disposed adjacent to the packaging station;

(i) directing a stream of air toward the open end of the bags so as to inflate and open the topmost bag and then filling the inflated open bag with an article to be packaged.

The present invention also comprehends a packaging apparatus for sequentially opening and filling flattened flexible packaging bags one at a time at a packaging station from a stacked supply of bags, each bag having wicket holes provided in a portion thereof adjacent to its open end, the stacked supply of packaging bags being held together by a wicket extending though the wicket holes provided in each bag, which apparatus comprises, in combination:

(a) an apparatus frame having an aft and a fore end;

(b) a packaging table mounted on the apparatus frame and adapted to be at least partially removed therefrom, said packaging table having a substantially flat horizontal surface for holding a plurality of packaging bags in a substantially flatwise manner adjacent to the packaging station;

(c) means provided on said apparatus frame for storing a stacked and wicket held supply of packaging bags in an area beneath the packaging table;

(d) means for positioning the wicket adjacent to the packaging station thereby enabling a selected number of the packaging bags to be periodically selected and removed from the top of the stacked and wicket held supply of bags and placed on top of the packaging table for use in the packaging operation while still held on the wicket; and (e) an air blower mounted on the aft end of the frame, the blower having a discharge nozzle for directing a stream of air towards the packaging bags placed on top of the packaging table, the air stream inflating and opening the topmost bag.

In a preferred embodiment of the present invention, the wicket includes a substantially rigid upper portion having elongated leg members which are adapted to pass through the wicket holes in each of the bags. The lower portion of the wicket is preferably a flexible, tubular binding member extending upwardly through the wicket holes in each of the bags and joining with the legs on the upper portion of the wicket.

The substantially rigid upper portion of the wicket also preferably includes a straight horizontal center section which is adapted to bear down on a part of the topmost bag adjacent to its open end for holding the bags firmly in place during the bag opening and filling operation.

Also in a preferred embodiment of the present invention, the packaging table is composed of two substantially flat, horizontal panels which are hingeably joined together at the center of the table, the foremost panel being also hingeably joined to the fore end of the apparatus frame. This structure enables the packaging table to be easily removed from the top of the apparatus frame and placed aside while a stacked and wicket held supply of packaging bags is loaded into the storage area.

In order to facilitate the bag loading operation, the air blower assembly is preferably pivotally mounted to the aft end of the apparatus frame so that the whole assembly can be easily lifted or rotated to a remote position. The blower assembly also preferably incorporates a substantially flat, horizontal top surface for supporting an article to be packaged.

In those instances where a substantially rigid wicket is used in conjunction with a stacked supply of packaging bags, it is desirable to employ a wicket holder on the apparatus frame for locating the rigid wicket in place at the packaging station. The wicket holder assures that each bag will be properly aligned with its open end facing toward the discharge nozzle on the air blower assembly.

In a preferred embodiment of the apparatus, the wicket holder is an elongated, rectangular block having open grooves provided in its side wall for receiving and holding the rigid wicket. A U-shaped wicket retainer adapted to fit around the side walls of the wicket holder may also be employed to retain the rigid wicket in place inside the wicket holder, this retainer being preferably mounted adjacent to the rearward end of the packaging table so that the retainer is automatically disengaged when the table is removed from the apparatus frame. cl

BRIEF DESCRIPTION OF THE DRAWING

The present invention will now be described in greater detail with particular reference to the preferred embodiments thereof which are illustrated in the accompanying drawing wherein.

DETAILED DESCRIPTION

Figure 1:
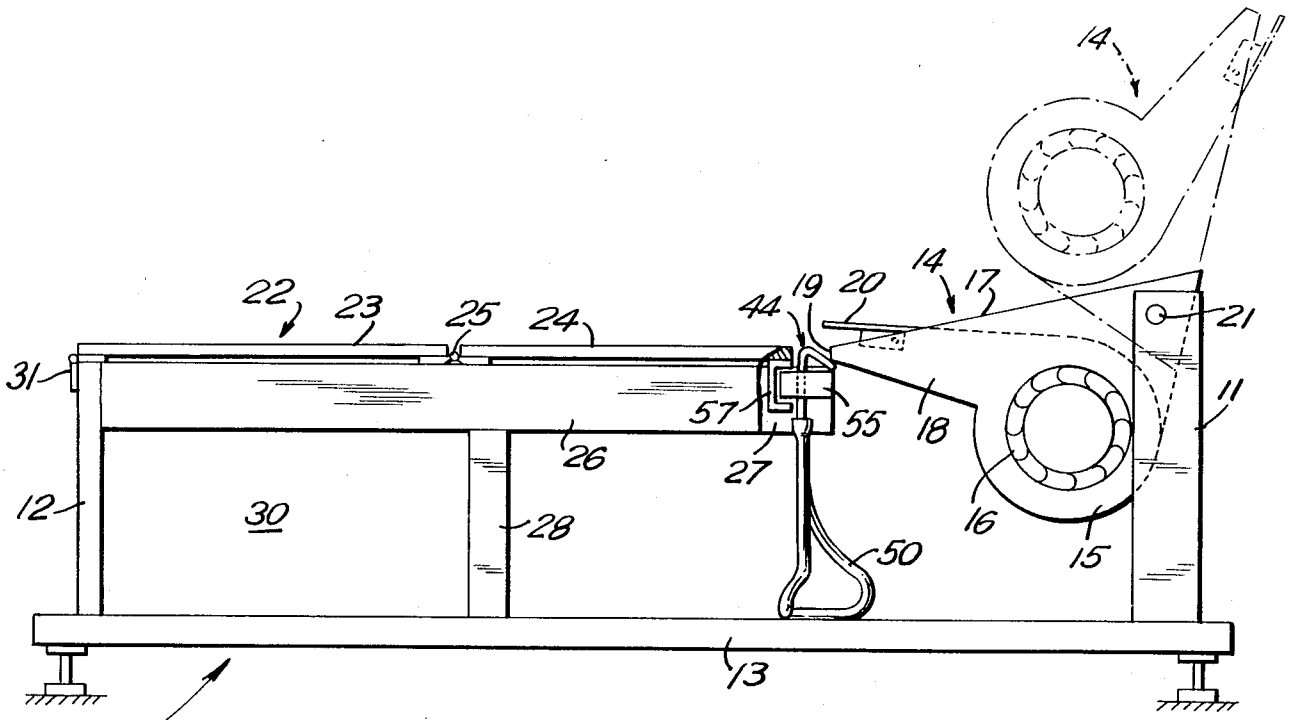
FIG. 1 is a side elevational view of apparatus according to the present invention as the apparatus appears just prior to loading the storage area with a new supply of bags, the blower assembly being shown in its raised or rotated position in phantom lines.

Referring to the drawing and particularly FIGS. 1 and 3–7 inclusive, a packaging apparatus according to the present invention includes a frame 10 having an aft end 11 and a fore end 12. A flat horizontal base plate 13 is supported by the frame 10 at the bottom of the apparatus. Mounted pivotally on the aft end 11 of the frame 10 is an air supply blower assembly indicated at 14. This blower assembly 14 includes a housing 15 which encloses and supports a motor driven air blower 16. The housing 15 has a flat, elongated, substantially horizontal top surface 17 which forms part of a nozzle 18. The nozzle 18 is provided with an air discharge opening 19 at its outer end. A pivoted flapper 20 is mounted on the nozzle 18 adjacent to the discharge opening 19 for regulating the angle at which the air stream is directed from the nozzle 18. As shown more particularly in FIGS. 3 and 4, the blower assembly 14 can be raised to a substantially vertical position by pivoting the housing 15 on horizontal trunnions 21 disposed at the aft end 11 of the frame 10.

Mounted on top of the frame 10 and spaced above the base plate 13 is a flat packaging table indicated generally at 22. This table is made of two separate, elongated panels 23, 24, which are joined together by a hinge 25. The hinge 25 is secured to the underneath side of both panels 23, 24 along their adjoining lateral edges at the center of the table 22. The panels 23, 24 rest on top of two spaced apart, elongated, horizontal aprons 26, 27 as best shown in FIG. 1. The two aprons 26, 27 are each mounted to the fore end 12 of the frame 10 and are secured midway along their length by stanchions 28. The stanchions 28 are attached to and extend upwardly from the base plate 13. It will be seen from the above description that the two panels 23, 24, while they rest in position on top of the horizontal aprons 26, 27, provide a flat, elongated surface for supporting a plurality of packaging bags 29 on top of the apparatus as more particularly shown in the view of FIG. 7. It will also be seen from the above description that the frame 10 taken in conjunction with the table 22 and base plate 13 defines an open area 30 for storing a stacked and wicket held supply of the packaging bags 29 as shown in the several views of FIGS. 3, 4 and 7.

Figure 7:
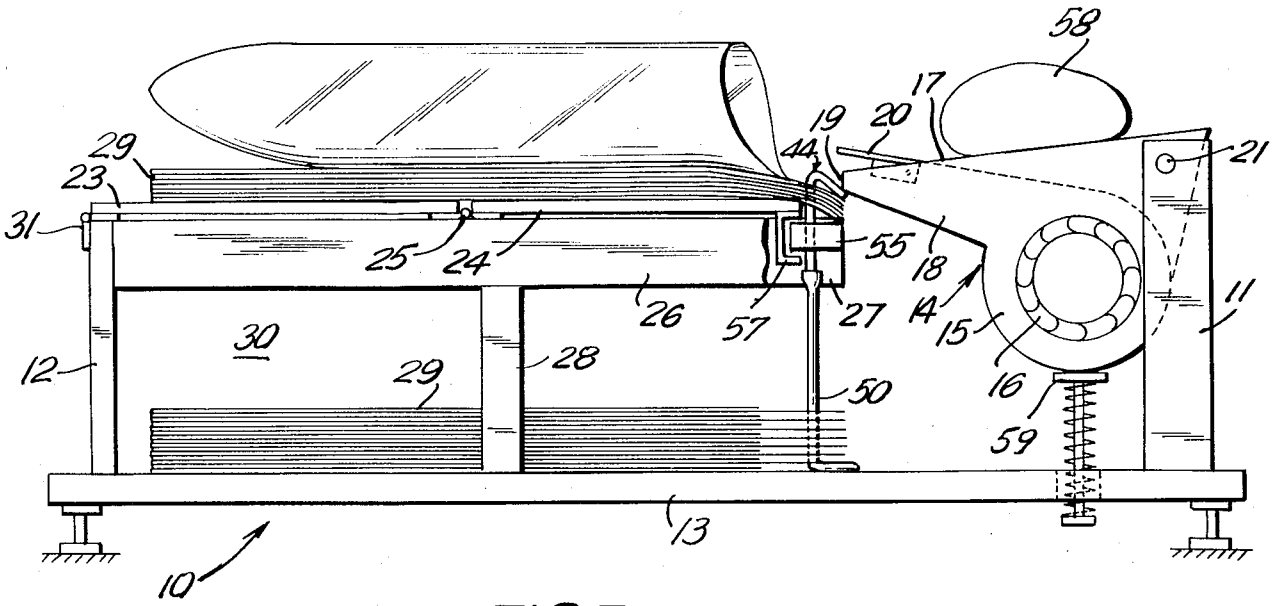
FIG. 7 is a view similar to FIGS. 1, 3 and 4 showing apparatus according to the present invention as the apparatus appears during the packaging operation.

The two panels 23, 24 joined by the center hinge 25 are pivotally mounted to the fore end 12 of the frame 10 also by a hinge 31. The hinge 31 is secured to the underneath side of the forward panel 23 along its lateral edge disposed adjacent to the fore end 12. This structure enables the two panels 23, 24 to be removed from their normally horizontal position by simply lifting the two panels upwardly while they rotate about the center hinge 25 and simultaneously sliding the panels forward along the horizontal aprons 26, 27 in a manner depicted, for example, by the phantom lines in FIG. 4. It will also be noted that the overall length of the two panels 23, 24 is chosen such that when the blower assembly 14 is placed in its normally horizontal operating position as shown in FIGS. 1 and 7, the discharge open end 19 of the nozzle 18 will clear the edge of the rear panel 24.

Figure 2:
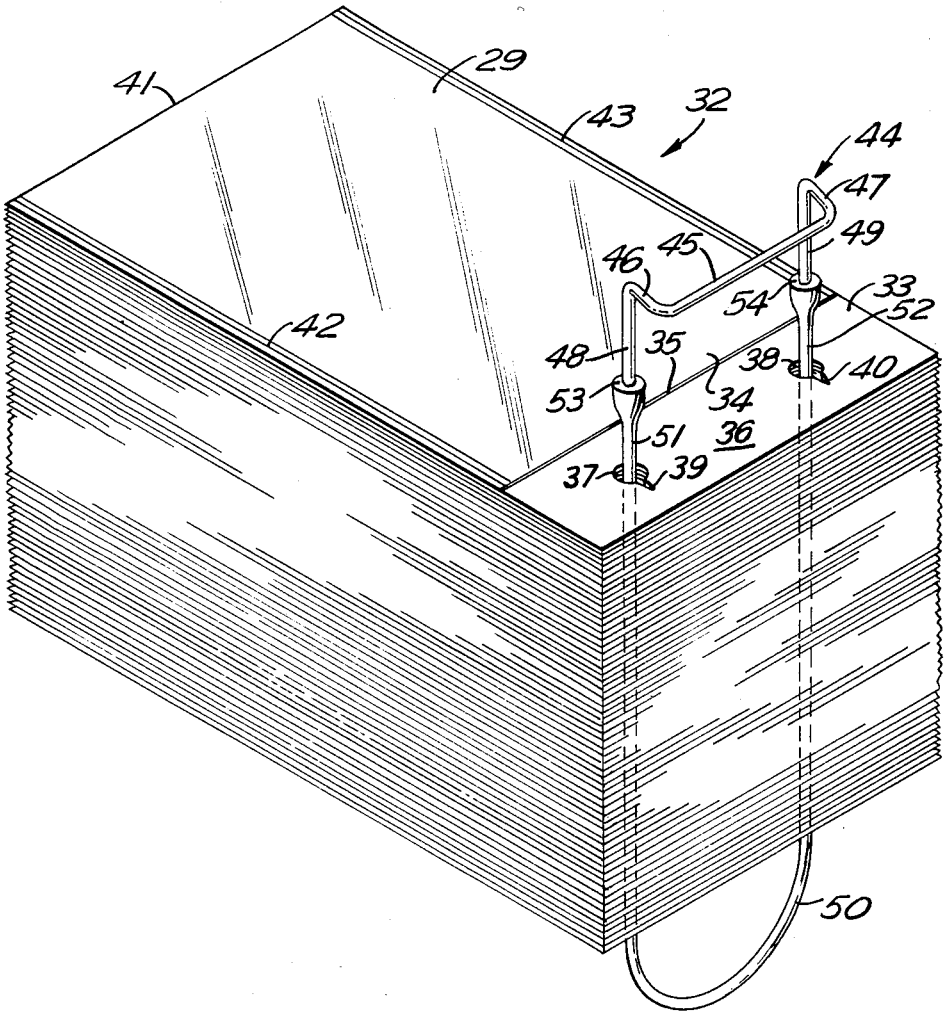
FIG. 2 is a perspective view of a preferred wicket bag packet for use in the apparatus of the present invention.

FIG. 2 illustrates a wicket bag packet for use in the practice of the present invention. As shown, the bag packet includes a plurality of individual, flattened, flexible packaging bags 29 which are arranged in a flatwise contiguous manner to form a stacked supply of bags as indicated at 32. Each bag 29 is preferably made from a single sheet of plastic film material, e.g., polyethylene, polypropylene, etc., which is folded upon itself to form two plys, namely, a lower ply 33 and an upper ply 34. The upper ply 34 has a top edge 35 which is made deliberately short so as to clear the corresponding top edge of the lower ply 33 and thereby provide a lip portion 36 adjacent to the open end of each bag. A pair of wicket holes 37, 38 are formed in the lip portion 36 of each bag along with a tear slit 39, 40, respectively, for direction prone tearing of the lip portion 36. All of the wicket holes 37, 38 in the contiguous bags are maintained in substantial registration with one another throughout the stacked supply of bags 32. Each bag is closed at its bottom end 41 and is provided with two side seals 42, 43 by heat sealing or the like.

A rigid wicket 44 is provided in the bag packet for holding a number of the packaging bags 29 on top of the table 22 in position ready for use during operation of the packaging apparatus. In a preferred form of the rigid wicket as illustrated in FIG. 2, the wicket is generally M-shaped with a straight center section 45 which turns upwardly at each end to define a pair of shoulders 46, 47. The shoulders 46, 47 are in turn joined by a pair of downwardly extending wicket legs 48, 49. The wicket 44 may be made from any rigid metal, e.g., aluminum or steel, or it may be molded from a rigid plastic material.

A flexible, tubular, U-shaped wicket binding member 50 is also provided for securing together the whole stacked supply of bags 32. The flexible binding member 50 has two leg portions 51, 52 which extend from the bottom of the stack through the pairs of wicket holes 37, 38 in all the bags. Preferably, the length of the binding member 50 is greater than the height of the stacked supply of bags so that a substantial portion of the binding member extends beyond the top or bottom or both of the stack. The open ends 53, 54 of the respective leg portions 51, 52 are pressed, heat sealed, glued or otherwise firmly attached or joined to the legs 48, 49 of the rigid wicket 44. Thus, it will be seen that the flexible binding member 50 taken in conjunction with the rigid wicket 44 provides a continuous flexible binding loop which serves to effectively hold the whole stacked supply of bags 32 in a neatly arranged and easily handled bundle. The binding member may be solid as well as tubular and may be made from any number of flexible materials such as polyethylene, vinyl, rubber and the like.

It should be noted at this point that the width of the rigid wicket 44 is chosen such that two wicket legs 48, 49 extend freely though the pair of wicket holes 37, 38 provided in each of the packaging bags for holding a number of the bags on top of the table 22 as mentioned above. However, it is not necessary to place the legs 48, 49 of the wicket down through the wicket holes 37, 38 in each of the bags during the time when the bag packet is being handled, shipped or placed in storage. The rigid wicket 44 may hang freely on top of the bag packet and serves as a convenient handle for carrying the packet. The flexible binding member 50 attached to the rigid wicket 44 at the same time holds together the entire stacked supply of bags. The bag packet described hereinabove is disclosed and claimed in the copending application of J. A. Nausedas, Ser. No. 649,292, filed Sep. 11,1984, which is a continuation of application Ser. No. 454,482, filed Dec. 29, 1982, now abandoned, and assigned to the common assignee hereof.

Figure 5:
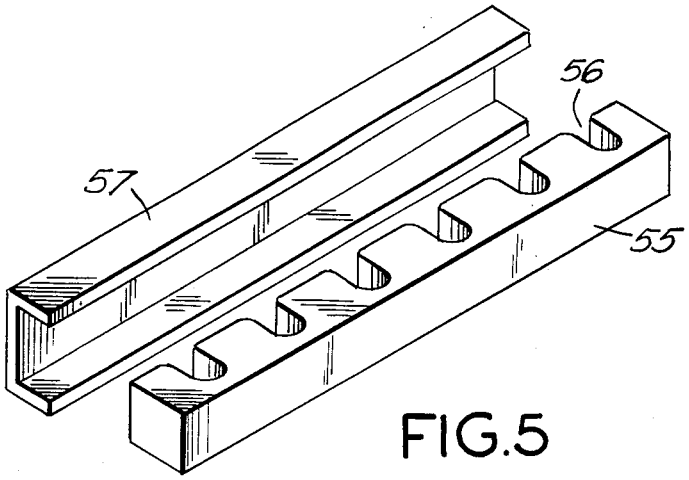
FIG. 5 is a perspective view of the grooved wicket holder block and U-shaped wicket retainer used in the apparatus.
Figure 6:
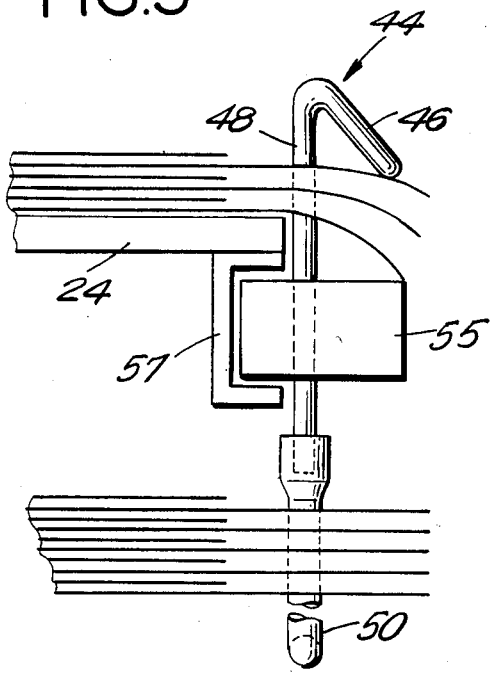
FIG. 6 is an enlarged detailed view of a portion of the apparatus showing the U-shaped retainer engaging the wicket holder block for holding a wicket in place.

As more particularly shown in FIGS. 5 and 6 a wicket holder 55 is provided for receiving the rigid wicket 44. The wicket holder 55 may be made from an elongated, rectangular block having formed within its side walls a series of spaced apart open grooves 56 for receiving and holding the rigid wicket 44. The wicket holder 55 is preferably mounted between the two aprons 26, 27 within the rearward end of the table 22 with the series of grooves 56 facing outwardly in a forward direction toward the fore end 12 of the frame 10. The wicket holder 55 may employ any number of grooves 56 to accommodate wickets of varying width commonly used in the industry. It will be seen that when the legs 48, 49 of a rigid wicket 44 are placed inside a particular pair of grooves 56 on the side wall of the wicket holder 55, the wicket 44 will be held in a substantially vertical position just in front of the discharge opening 19 of the nozzle 18.

A U-shaped wicket retainer 57 is also provided for retaining the rigid wicket 44 inside the wicket holder 55. The wicket retainer 57 is preferably attached to the underneath side of the rear panel 24 at a location such that when the panel 24 is placed down flat on top of the two horizontal aprons 26, 27, the U-shaped retainer 57 will automatically engage with the wicket holder 55 as best shown in the view of FIG. 6. The U-shaped retainer 57 is of a size such that its side walls will fit snugly over the wicket holder 55 to close off the series of open grooves 56. It is important to note, however, that the U-shaped retainer 57 does not actually lock the wicket legs 48, 49 in the grooves 56 but rather only loosely holds the legs in place allowing the rigid wicket 44 freedom to move downwardly through the wicket holder 55 as the article filled bags are removed from the top of the packaging table 22.

Figure 3:
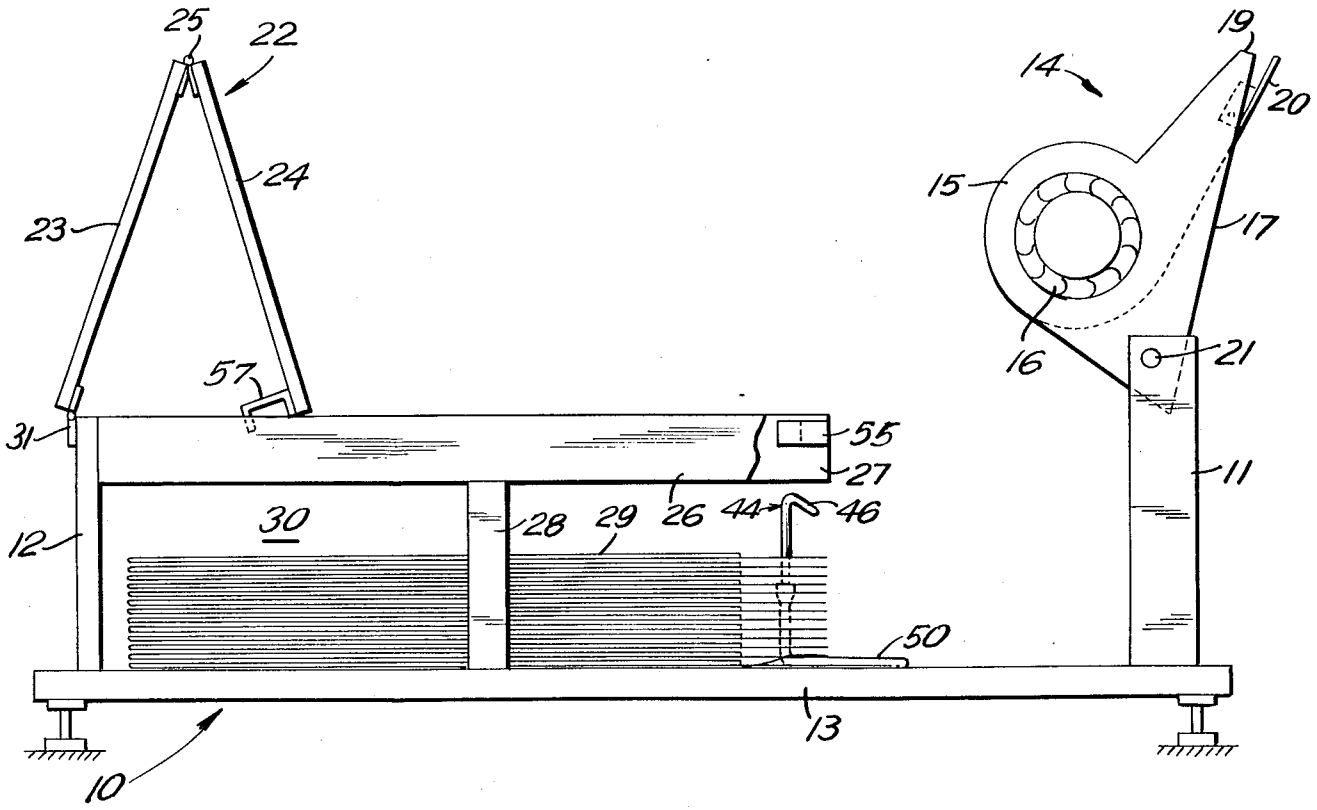
FIG. 3 is a side elevational view of apparatus according to the present invention as the apparatus appears during the loading operation, with a new supply of bags placed inside the storage area and with the moveable hingeably joined top panels partly removed.
Figure 4:
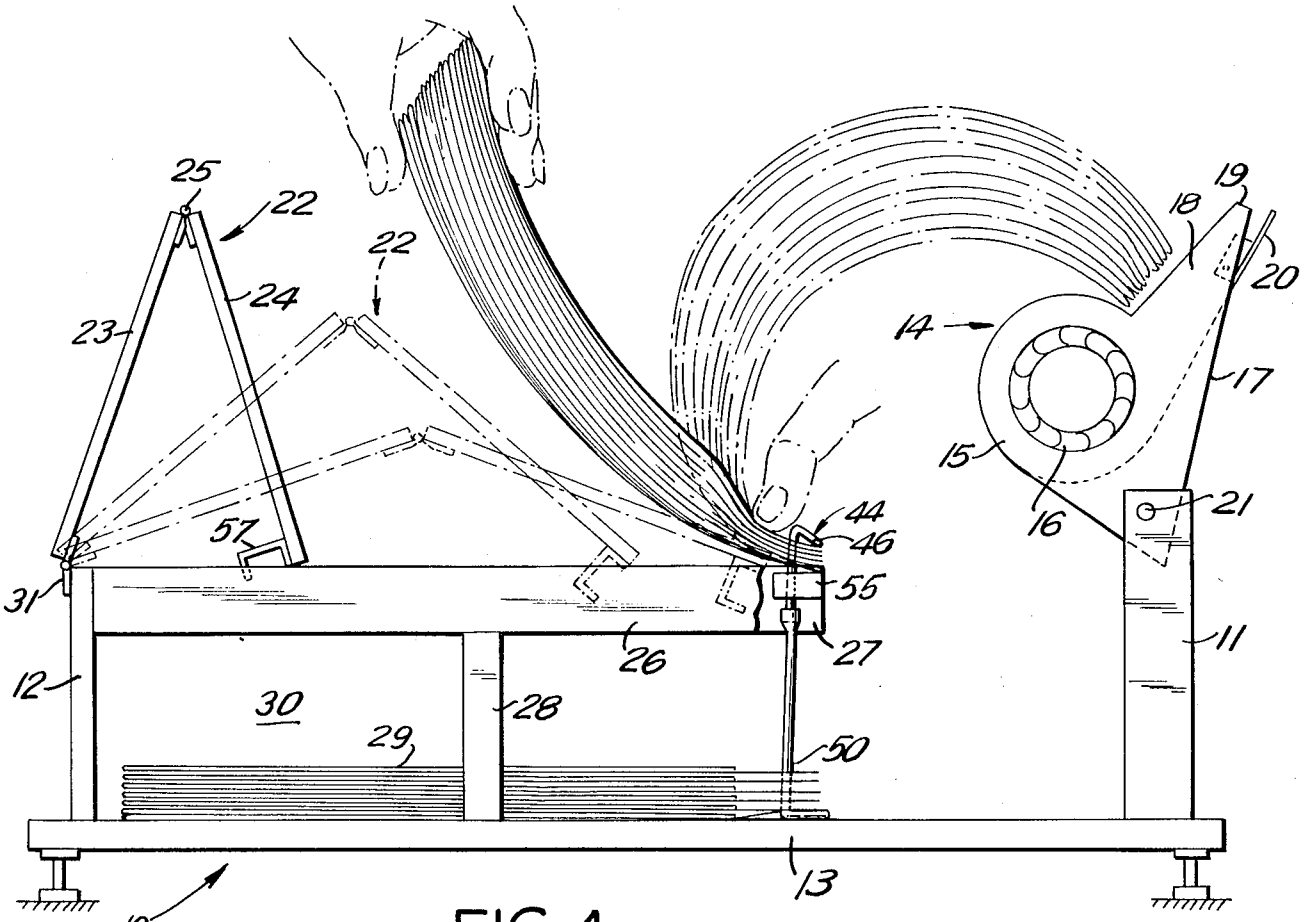
FIG. 4 is a similar view of apparatus according to the present invention, illustrating the various steps involved in removing a selected number of bags from the storage area.

Operation of the apparatus according to the present invention involves first loading the storage area 30 with a stacked supply of packaging bags preferably in the form of a bag packet such as shown in FIG. 2. Assuming the apparatus has been used previously to package articles such as bakery goods, meat cuts and the like, then in that case, the wicket assembly from the prior bag packet including a rigid wicket 44 will remain in place inside the wicket holder 55 as shown, for example, in FIG. 1. To facilitate removal of the wicket assembly and also permit ready access to the storage area 30, the air supply blower assembly 14 is rotated clockwise about the pinions 21 to an elevated position as shown by phantom lines in the drawing. This removes the discharge opening 19 of the nozzle 18 from its normally operating position on top of the rigid wicket 44. The two panels 23, 24 are removed from the table as described above by lifting the panels and moving them in a forward direction along the aprons 26, 27 toward the fore end 12 of the apparatus frame 10. The removal of the two panels 23, 24 also disengages the wicket retainer 57 mounted on the underneath side of the rear panel 24. The wicket 44 left behind from the prior bag packet is easily removed from the wicket holder block 55 and is then discarded. A new bag packet is loaded into the storage area 30 by dropping it through the open space left behind by the removal of the panels 23, 24. The whole packet is placed down flat on top of the horizontal base plate 13 with its rigid wicket 44 located just beneath the wicket holder block 55, as shown in FIG. 3.

The operator then grasps the rigid wicket 44 in one hand lifting it upwardly beyond the bag packet while grasping with the other hand a selected number of packaging bags to be used during the packaging operation. The bags are then removed from inside the storage area 30 by sliding the bags upward along the elongated wicket legs 48, 49 until the bags reach a point near the top of the rigid wicket 44. The legs 48, 49 of the rigid wicket 44 are then inserted into a pair of grooves 56 located on the side wall of the wicket holder block 55. With the fingers of one hand temporarily holding the rigid wicket 44 in place inside the holder block 55, the operator then lifts the packaging bags upwardly to a remote location away from the packaging table 22 as depicted by the phantom lines in FIG. 4. The two hingeably joined top panels 23, 24 are then lowered and moved backwardly, as depicted by phantom lines, along the aprons 26, 27, until they rest flat on top of the aprons. It will be seen in particular that during this step the two panels 23, 24 are placed underneath the packaging bags 29 held elevated by the operator's hand while at the same time the U-shaped wicket retainer 57 moves again into engagement with the wicket holder block 55. With the rigid wicket 44 held in place inside the holder block 55, the packaging bags 29 are now placed down flatwise on top of the two hingeably joined panels 23, 24 as shown in FIG. 7. The air blower assembly 14 is then lowered again by rotating it counterclockwise about the trunnions 21 until the discharge opening 19 of the nozzle 18 rests in its normally operating position on top of the straight center section 45 of the rigid wicket 44. (See FIG. 7.)

The air blower 16 is then activated and a continuous stream of air is directed from the discharge opening 19 of the nozzle 18. This air stream passes over the top of the packaging bags 29 placed on the table 22 and inflates the topmost bag as illustrated in FIG. 7. An article to be packaged such as a meat cut 58 is placed on top of the substantially horizontal top surface 17 of the blower assembly 14, from whence the meat cut or other product may be easily directed into the open inflated bag. Guide means may also be provided on the top surface 17 for guiding the article into the bag as described in U.S. Pat. No. 3,763,627. Once the bag has been filled with the article, the filled bag is removed from the packaging table 22 by pulling the bag in a direction toward the fore end 12 of the frame 10. This causes the legs 48, 49 of the rigid wicket to tear through the bag lip 36 along the tear slits 39, 40 (see FIG. 2). The continuous stream of air from the discharge opening 19 of the nozzle 18 again inflates the next topmost bag 29 and the whole process for sequentially opening and filling the packaging bags is repeated again in sequence.

It is important to note that throughout the bag opening and filling operation as described above, the packaging bags 29 that are placed on top of the packaging table 22 are always maintained in proper alignment with the discharge opening 19 of the nozzle 18 by the co-action of both the holder block 55 and U-shaped wicket retainer 57. These two members, when engaged, serve to hold in place the rigid wicket 44 which in turn maintains alignment of the bags 29. In addition, it should be noted that the weight of the discharge opening 19 of nozzle 18 on top of the center section 45 of the rigid wicket 44 serves to hold down the bag lip 36 and thereby facilitate the bag opening operation. In this connection, the ability of the rigid wicket 44 to move freely downwardly through the holder block 55, as the bags 29 are filled and removed, is important since this feature allows the wicket 44 to exert a substantially constant pressure at all times on the lip 36 of each bag 29. It may be desirable in some instances to also employ a spring-loaded support pad 59 located underneath the blower housing 15 in order to help in counter-balancing the weight of the nozzle 18 on the wicket assembly.

An important feature of the present invention resides in the flexible, tubular, U-shaped binding member 50. As can be seen particularly in the view of FIG. 7, this flexible binding member 50 holds the stacked supply of packaging bags 29 which remain in the storage area 30 without adding the weight of these bags onto the rigid wicket 44 and otherwise interfering with the operations of the packaging apparatus. As indicated above, the length of the flexible binding member 50 is greater than the height of the stacked supply of bags so that a substantial portion of the binding member extends beyond the top or bottom or both of the stack. This allows the bags to rest completely on top of the base plate 13 without adding the weight of the bags to the wicket 44. Of course, the base plate 13 must also be positioned on the apparatus frame 10 such that for any given bag packet, the bags will be supported independently on the plate. It will be seen, therefore, that virtually any number of packaging bags can be employed in a single bag packet. It will be further noted that more than one bag packet can be kept in the storage area 30, that is two or more packets can be stored one on top of the other or side by side for convenience sake, although only one bag packet is used at a time during the packaging operations.

Figure 8:
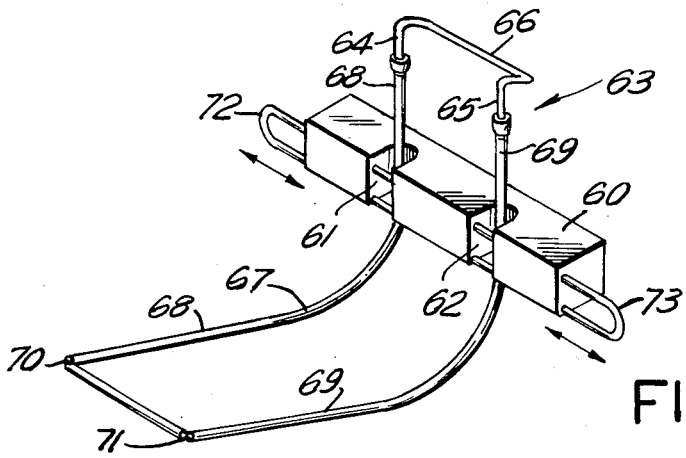
FIG. 8 is a perspective view of a part of the apparatus showing a modification of the present invention. cl

A modification of apparatus according to the present invention is shown in FIG. 8. In this modification, a wicket holder block 60 is provided with at least two open grooves 61, 62 in its side wall for receiving and holding the substantially upper portion of a wicket 63. The upper portion of this wicket 63 is rigid and has elongated legs 64, 65 and a straight center section 66. The lower portion of the wicket 63 is a substantially U-shaped tubular binder member 67 having elongated leg portions 68, 69 which are adapted to extend from the bottom of a stacked supply of bags (not shown) through the wicket holes in each bag as described hereinabove. The leg portions 68, 69 also join at their upper ends with the elongated legs 64, 65 provided on the upper portion of the wicket 63. The U-shaped binder member 67 may be made from a flexible, semi-rigid or rigid material. In the case where the binder member 67 is made from a semi-rigid or rigid material, the lower end of the binder member 67 may be formed by bending, crimping or the like or more preferably by cutting the tube at two places as at 70, 71, the cuts extending only partly across the tube, e.g., about 180°, and then bending the tube at these points to form the substantially U-shaped tubular binder member 67. The binder member 67 may of course vary somewhat in its configuration from a substantially U-shaped member having square corners to one having smooth rounded corners as essentially shown in FIG. 1. The center portion of the binder member 67 is preferably made of sufficient lengths so that the continuous loop formed by the legs 68, 69 extend a substantial distance underneath the stacked supply of packaging bags when initially loaded into the storage area 30 of the packaging apparatus.

An important feature of this modification is the provision of slideable wicket retainers 72, 73 incorporated directly inside the wicket holder block 60. The wicket retainers 72, 73 are preferably U-shaped metal rods extending from the side wall of the block 60 into each groove 61, 62, respectively. The U-shaped retainer rods 72, 73 are adapted to move inside the block 60 in either direction as indicated by the arrows and thus can be employed to open and close the grooves 61, 62 when installing or removing a wicket. It will be readily seen that this embodiment eliminates the necessity for a separate wicket retainer.

Although it is preferred to employ a wicket assembly which includes a substantially rigid upper portion having elongated legs extending through the wicket holes in each of the bags, along with a lower flexible tubular portion forming a binder member for holding together a stacked supply of packaging bags, the present invention is not at all restricted to the use of this particular wicket assembly and other wickets can of course be employed successfully during operation of the packaging apparatus. For example, it is entirely possible to employ in the present apparatus a wicket having both upper and lower portions which are substantially rigid, such wickets being more or less of conventional design such as disclosed in U.S. Pat. Nos. 3,770,134 and 3,777,930. Substantially rigid wickets of this type may be readily held in place by the combined wicket holder and wicket retainer of the present invention instead of locking the wickets in conventional sockets or the like. It is also possible to employ in conjunction with the method and apparatus according to the present invention wickets made entirely from a flexible material. A wicket similar to this proposal is disclosed in U.S. Pat. No. 4,262,803. Finally, it is also possible to employ a wicket assembly including a substantially rigid lower portion for holding together a stacked supply of packaging bags and an upper portion which is flexible, such as a flexible tube. In variations in which at least the upper portion of the wicket is flexible, it will suffice to provide means to position and maintain the flexible wicket next to the blower nozzle thus aligning the bags for proper operation of the apparatus. For example, the discharge end of the air nozzle can be employed as a retainer for the flexible wicket.

It will be readily seen from the above description that the present invention provides an improved packaging method and apparatus which enables the use of a stacked and wicket held supply of packaging bags incorporating a greater number of individual bags than heretofore possible without causing any serious misalignment problems. Further, the present invention provides an improved packaging method and apparatus which permits a selected number of bags from the stacked and wicket held supply of bags to be placed in position ready for use at the packaging station while the remaining bags are held apart in a separate storage area. It will also be readily seen from the description that these advantages are readily obtained irregardless of the type of wicket assembly that may be used, that is to say, the present invention is applicable to the employment of rigid, flexible or partly rigid and partly flexible wickets.

What is claimed is:

1. A packaging apparatus for sequentially opening and filling flattened flexible packaging bags one at a time at a packaging station from a stacked supply of bags, each bag having wicket holes provided in a portion thereof adjacent to its open end, the stacked supply of packaging bags being held together by a wicket extending through the wicket holes provided in each bag, which apparatus comprises, in combination:

(a) an apparatus frame having an aft and a fore end;

(b) a packaging table mounted on said apparatus frame and adapted to be at least partially removed therefrom, said packaging table having a substantially flat, horizontal surface for holding a plurality of said packaging bags in a substantially flatwise manner adjacent to said packaging station;

(c) means provided on said apparatus frame for storing a stacked and wicket held supply of packaging bags in an area beneath said packaging table;

(d) means for positioning said wicket adjacent to said packaging station, thereby enabling a number of said packaging bags to be periodically selected and removed from the top of the stacked and wicket held supply of bags and placed on top of said packaging table for use in the packaging operation while still held on said wicket; and (e) an air blower mounted on the aft end of said frame, said blower having a discharge nozzle for directing a stream of air towards the packaging bags placed on top of said packaging table, the air stream inflating and opening the topmost bag.

2. Apparatus according to claim 1 wherein the packaging table includes two substantially flat panels hingeably joined together along adjacent lateral edges.

3. Apparatus according to claim 2 wherein the two substantially flat panels are hingeably joined together at the center of said packaging table.

4. Apparatus according to claim 2 wherein the two hingeably joined, substantially flat panels rest on a pair of horizontal aprons mounted to the fore end of said apparatus frame.

5. Apparatus according to claim 4 wherein one of the two hingeably joined, substantially flat panels is hingeably joined to the fore end of said apparatus frame.

6. Apparatus according to claim 1 wherein the storage means includes a substantially flat base plate mounted on said apparatus frame beneath said packaging table, the arrangement of said base plate being such as to support substantially the entire weight of said stacked and wicket held supply of bags.

7. Apparatus according to claim 1 wherein the wicket positioning means includes a wicket holder mounted within the rearward end of said packaging table and having means for receiving and holding said wicket in a substantially vertical position.

8. Apparatus according to claim 7 wherein the wicket holder comprises an elongated, rectangular block having a series of open grooves provided in its side wall for receiving and holding said wicket.

9. Apparatus according to claim 8 wherein the wicket positioning means further includes a substantially U-shaped wicket retainer adapted to fit over the side wall of said elongated, rectangular wicket block for holding said wicket in said open grooves.

10. Apparatus according to claim 9 wherein the substantially U-shaped wicket retainer is adapted to loosely hold said wicket in said open grooves and allow said wicket freedom to move downwardly through said wicket holder.

11. Apparatus according to claim 9 wherein the packaging table includes two substantially flat panels hingeably joined together along adjacent lateral edges with one of said panels being in turn hingeably joined to the fore end of said apparatus frame, and wherein said substantially U-shaped wicket retainer is mounted to the underneath side of the other of said panels, the arrangement being such as to cause said retainer to automatically engage and disengage with said wicket holder block when said panels are moved into and out of position on top of said apparatus frame.

12. Apparatus according to claim 11 wherein the two substantially flat panels are hingeably joined together at the center of said packaging table.

13. Apparatus according to claim 9 wherein a moveable wicket retainer is incorporated directly inside said wicket holder block for opening and closing said grooves.

14. Apparatus according to claim 1 wherein the air blower is incorporated inside a blower housing which is pivotally mounted to the aft end of said apparatus frame.

15. Apparatus according to claim 14 wherein the blower housing is provided with a substantially flat, horizontal surface for supporting an article to be packaged.

16. Apparatus according to claim 15 wherein the substantially flat, horizontal surface on said blower housing includes means for directing a said article into the inflated open bag.

17. A method for sequentially opening flattened, flexible packaging bags one at a time at a packaging station and then filling each open bag with an article to be packaged, each bag having wicket holes provided in a portion adjacent to its open end, comprising:

(a) providing a plurality of the packaging bags arranged in a flatwise contiguous manner one on top of the other forming a stacked supply of packaging bags, each bag having wicket holes maintained in substantial registration with the wicket holes in adjacent bags, said stacked supply of packaging bags being held together by a wicket including an upper portion and a lower portion, said lower portion of said wicket being contiguous with said upper portion and extending through said wicket holes provided in each bag, and said upper portion of said wicket extending outwardly beyond said stacked supply of bags;

(b) placing said stacked and wicket held supply of packaging bags within a storage area located beneath said packaging station;

(c) selecting a number of said packaging bags from the top of said stacked supply of bags and removing the same from said storage area while still held on said wicket;

(d) guiding the selected packaging bags along the upper portion of said wicket;

(e) placing said upper portion of said wicket in a substantially vertical position adjacent to said packaging station;

(f) holding said selected packaging bags at a location adjacent to said packaging station while at the same time placing a substantially flat, horizontal surface underneath said bags, said substantially flat, horizontal surface overlying the remainder of said stacked supply of bags held within said storage area;

(g) retaining said upper portion of said wicket in place at said packaging station;

(h) placing said selected packaging bags down on top of said substantially flat, horizontal surface with the open end of said bags disposed adjacent to said packaging station;

(i) directing a stream of air toward the open end of said bags so as to inflate and open the topmost bag and then filling the inflated open bag with an article to be packaged;

(j) removing the article filled bag from said wicket and exposing the next topmost bag to said air stream; and (k) repeating steps (c) through (j) after the last of said selected bags has been inflated and filled with an article to be packaged.

18. Method according to claim 17 wherein the upper portion of said wicket comprises a substantially rigid wicket element having elongated leg portions and wherein the lower portion of said wicket comprises a flexible tubular binding member extending through the wicket holes in each of said bags in said stacked supply of bags and having its open ends joined with the elongated leg portions of said rigid wicket element.

19. Method according to claim 18 wherein the rigid wicket element is located inside a wicket holder block having open grooves in its side walls adapted to receive and hold the elongated leg portions of said rigid wicket element.

20. Method according to claim 19 wherein the substantially rigid wicket element is periodically removed from the open grooves in said wicket retainer block to enable said selected packaging bags to be removed from said storage area and guided along said wicket element toward said packaging station.

21. Method according to claim 20 wherein the substantially rigid wicket element is held inside said open grooves in the side wall of said wicket holder block by a removable wicket retainer.

22. Method according to claim 17 wherein the substantially flat, horizontal surface placed underneath said bags comprises two hingeably joined panels overlying said storage area.

23. A system for holding a substantially rigid wicket having elongated leg portions comprising, in combination: a wicket holder block having open grooves provided in the side wall thereof for receiving and holding said elongated leg portions of said rigid wicket and a removeable wicket retainer adapted to engage with said wicket holder block for retaining said rigid wicket inside said open grooves.

24. A system according to claim 23 wherein said wicket retainer comprises a substantially U-shaped retainer member adapted to fit over the side walls of said wicket holder block.

25. A system according to claim 24 wherein said wicket retainer is adapted to loosely hold said wicket in said open grooves and allow said wicket freedom to move downwardly through said wicket holder block.

26. A system according to claim 23 wherein said wicket retainer comprises a substantially U-shaped rod slideably mounted inside said wicket holder block for opening and closing said open grooves therein.

27. A method for opening flattened flexible packaging bags one at a time at a packaging station and then filling each open bag with an article to be packaged, the packaging bags being arranged in a flatwise contiguous manner one on top of the other forming a stacked supply of packaging bags, each bag having wicket holes maintained in substantial registration with the wicket holes in adjacent bags, said stacked supply of packaging bags being held together by a wicket including an upper portion and a lower portion, said lower portion of said wicket being contiguous with said upper portion and extending through said wicket holes provided in each bag, and said upper portion of said wicket extending outwardly beyond said stacked supply of bags; said method comprising:

(a) placing said stacked and wicket held supply of packaging bags within a storage area located beneath said packaging station;

(b) selecting one or more of said packaging bags from the top of said stacked supply of bags and removing the same from said storage area while still held on said wicket;

(c) guiding the selected packaging bags along the upper portion of said wicket;

(d) holding said upper portion of said wicket at a location above said stacked supply of packaging bags;

(e) placing a substantially flat, horizontal surface underneath said bags, said substantially flat, horizontal surface overlying the remainder of said stacked supply of bags held within said storage area;

(f) retaining said upper portion of said wicket in place at said packaging station;

(g) placing said selected packaging bags on top of said substantially flat, horizontal surface with the open end of said bags disposed adjacent to said packaging station; and (h) directing a stream of air toward the open end of said bags so as to inflate and open each bag and then filling the inflated open bag with an article to be packaged.

* * * * *